US005939668A

United States Patent [19]

De Win

[11] Patent Number: 5,939,668

[45] Date of Patent: Aug. 17, 1999

[54] PATCH CABLE

[75] Inventor: Paul De Win, Huizingen, Belgium

[73] Assignee: Alcatel Alsthom Compagnie Generale d'Electricite, Paris, France

[21] Appl. No.: 09/022,427

[22] Filed: Feb. 12, 1998

[30] Foreign Application Priority Data

Feb. 12, 1997 [EP] European Pat. Off. ..... 97200408

[51] Int. Cl.[6] ..... H01B 7/34

[52] U.S. Cl. ..... 174/36; 174/106 R; 174/113 R; 174/78

[58] Field of Search ..... 174/36, 103, 106 R, 174/113 R, 74 R, 78

[56] References Cited

U.S. PATENT DOCUMENTS

| | | | |
|---|---|---|---|
| 4,010,315 | 3/1977 | Mildner | 174/106 R X |
| 4,096,346 | 6/1978 | Stine et al. | 174/36 |
| 4,477,693 | 10/1984 | Krabec et al. | 174/36 |
| 4,510,346 | 4/1985 | Bursh, Jr. et al. . | |
| 4,835,394 | 5/1989 | Steele | 174/36 X |
| 5,216,202 | 6/1993 | Yoshida et al. | 174/36 |
| 5,434,354 | 7/1995 | Baker et al. | 174/36 |

FOREIGN PATENT DOCUMENTS

| | | |
|---|---|---|
| 8-153545 | 6/1996 | Japan . |
| 1153152 | 5/1969 | United Kingdom . |

OTHER PUBLICATIONS

Patent Abstracts of Japan, vol. 96, No. 10, Jun. 11, 1996 & JP 08 15345 A (Oki Electric Ind).

*Primary Examiner*—Kristine Kincaid
*Assistant Examiner*—Chau N. Nguyen
*Attorney, Agent, or Firm*—Ware, Fressola, Van Der Sluys & Adolphson LLP

[57] ABSTRACT

A shielded patch cable has a series of wires and a first foil of an electrical conductive material, the first foil surrounding the series of wires over their length. The patch cable also has a capacitor for preventing the formation of a grounding loop upon connection of the cable. The capacitor is formed by the first foil surrounded by an intermediate layer of an electrical insulating material, which insulating material is surrounded by a second foil of an electrical conductive material.

11 Claims, 3 Drawing Sheets

PATCH CABLE

TECHNICAL FIELD

The present invention relates to a shielded patch cable comprising a series of wires and a first foil of an electrical conductive material, said first foil surrounding said series of wires over their length, said patch cable further comprising a capacitor for preventing the formation of a grounding loop upon connection of the cable.

BACKGROUND OF THE INVENTION

Such a shielded patch cable is known and sold by Telesafe under the name Safeground Patch Cable. In this cable, the first foil comprises a polyester layer applied on an aluminium layer. This first foil forms a shielding around the wires.

The known patch cable is provided for connecting two devices with each other, for example a PC with an outlet, which outlet is connected to a patch panel. When connecting the cable, a grounding loop is formed by the aluminium layer, which is at its both extremities connected to ground through the intermediary of the devices. In order to break this grounding loop, use is made of a capacitor. The capacitor is formed by an inner cylindrical tube and an outer cylindrical tube, both tubes being of an electrical conductive material and being separated by an electrical insulating layer. The aluminium layer of the cable is cut in a first part which is connected with the inner tube and a second part which is connected with the outer tube in such a manner that the grounding loop is broken by the formed capacitor. This principle is illustrated in FIG. 1, wherein 1 indicates the outer tube, 2 the inner tube, 3 the insulating layer, 4 the first part of the aluminium layer, 4 the second part of the aluminium layer and 5 the wires.

A drawback of the known cable is that the connection of the capacitor with the cable is relatively cumbersome and time-consuming, since the aluminium layer must be cut in two parts and at the same time care should be taken that the wires are not cut. Moreover, the capacitor forms a protruding rigid part which renders the cable inflexible at the capacitor's height.

SUMMARY OF THE INVENTION

The object of the invention is to provide a shielded patch cable which can be manufactured more easily and integrated in the manufacturing operation of the cable and which is still provided for breaking the grounding loop when the cable is connected.

To this object, the patch cable according to the invention is characterised in that said capacitor is formed by said first foil surrounded by an intermediate layer of an electrical insulating material, which insulating material is surrounded by a second foil of an electrical conductive material.

Since the capacitor is formed by the first foil, an intermediate layer and a second foil over the length of the wires, it is not necessary anymore to cut a layer for forming a capacitor. Manufacturing such a cable can easily to be performed in a single operation by applying the first and second foils and the intermediate layer. The formation of the capacitor can thus easily be integrated in the manufacturing process of a cable. When using a cable according to the invention for connecting two devices, the first foil is connected with a first of two devices and the second foil is connected with the second of the two devices. Thereupon, the formation of two electrical conductive layers instead of one improves also the shielding properties in the cable.

According to a first preferred embodiment, each of said foils comprises an aluminium layer. In particular, said intermediate layer is formed by a polyester layer applied on one side of at least one of said aluminium layers. This reduces the manufacturing time, since only two foils must be superposed to form said capacitor.

According to a second preferred embodiment said intermediate layer is formed by an insulating strip. Such an insulating strip improves the insulation between the aluminium layers.

According to a third preferred embodiment, the cable further comprises a first drain wire electrically contacting said first foil and a second drain wire electrically contacting said second foil. This facilitates the connection of the first and second foils with the devices.

The present invention further relates to a method for manufacturing a shielded patch cable comprising a series of wires, said method comprising the steps of: applying a first foil of an electrically conductive material around said wires; applying an intermediate layer of an electrically insulating material around said first foil; and applying a second foil of an electrically conductive material around said intermediate layer.

BRIEF DESCRIPTION OF THE DRAWINGS

The invention will now be described in detail referring to the annexed drawings.

BEST MODE FOR CARRYING OUT THE INVENTION

For the sake of clarity, some components are illustrated on an enlarged scale in the figures.

The shielded patch cable is provided to be used on a user side in a network, for example, for connecting a PC with a wall outlet, wherein the wall outlet pertains to a network. The cable could also be used for example for connecting patch panels with each other in a cabinet.

In a building, the grounding potential between two points is usually different. European standard EN 50173 imposes a maximum difference of grounding potential between two points of 1 Volt, which is in many cases difficult to achieve without expensive modifications. A solution for obviating these expensive modifications is achieved by preventing the formation of a grounding loop upon connection of a shielded cable. For this purpose, a cable provided with a capacitor is used.

Figure 1:
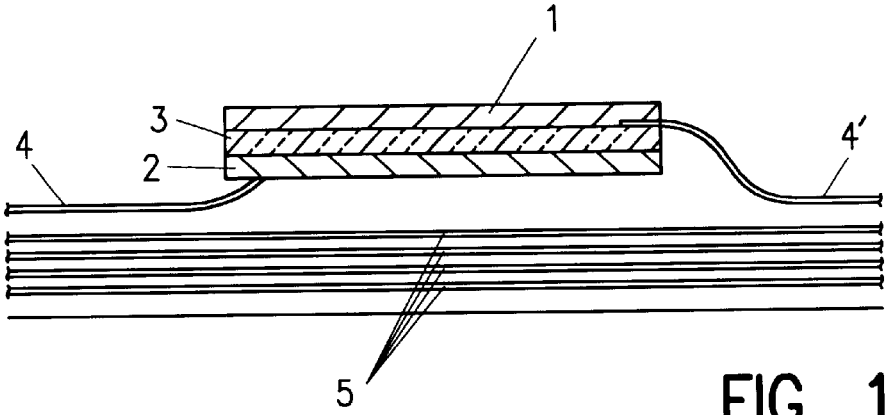
FIG. 1 (PRIOR ART)
FIG. 1 illustrates schematically a longitudinal section of a part of the patch cable comprising a capacitor according to the state of the art.
Figure 2:
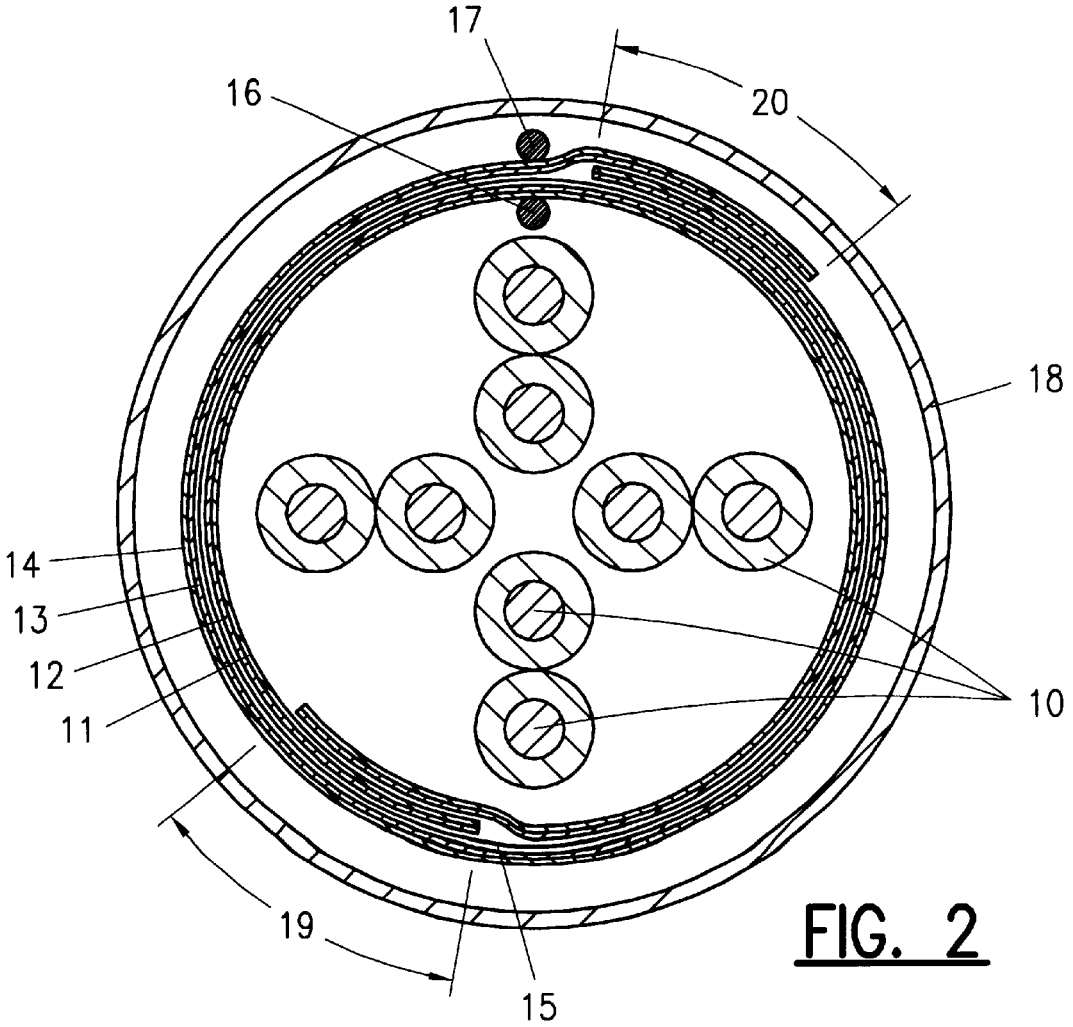
FIG. 2 is a cross section of a preferred embodiment of a shielded patch cable according to the invention.

As illustrated in FIG. 2, the cable comprises a series of wires 10, for example four pairs of wires. The wires 10 are surrounded over their length by a first foil 11, 12 comprising a layer of aluminium 11 onto which is placed a layer of polyester 12. A second foil 13, 14, also comprising a layer of aluminium 14 and a layer of polyester 13, is wrapped around the first foil 11, 12 and also extends over a whole cable length. Between the first and second foils, an insulating strip 15 is preferably provided. The insulating strip improves the insulation between the aluminium layers and prevents an electrical contact between the aluminium layers in case the polyester layers are locally damaged. The aluminium layers thus form conductive layers of a capacitor and the polyester layers with the insulating strip form a dielectric layer of the capacitor. Around the second foil 14, an outer jacket of for example PVC is formed.

According to an alternative embodiment, the capacitor is formed by two electrically conductive layers, for example aluminium layers, and one intermediate layer of an electrical insulating material. According to FIG. 2, the first and second foils are wrapped around the wires in such a manner that the two polyester layers are enclosed within the two aluminium layers. According to an alternative, only one polyester layer is provided between the aluminium layers.

As shown in FIG. 2, the first foil comprises a first overlapping section 19 extending over the length of the cable. Similarly, the second foil comprises a second overlapping section 20 extending over the length of the cable. Upon manufacturing the cable, care should preferably be taken that the overlapping sections 19 and 20 are not mutually overlapping, but are for example located on opposite sides of a diagonal D. In this way, the shielding properties are improved since stray currents have difficulty passing through both overlapping sections.

The cable preferably comprises a first drain wire 16 which electrically contacts the first foil 11 and a second drain wire 17 which electrically contacts the second foil 14. Upon connection of the cable with two devices, the firs drain wire 16 is connected with a first of the two devices and the second drain wire 17 is connected with the second of the two devices. This facilitates the connection, since connecting a wire is easier than connecting a layer, in particular an aluminium layer of a foil.

Figure 3:
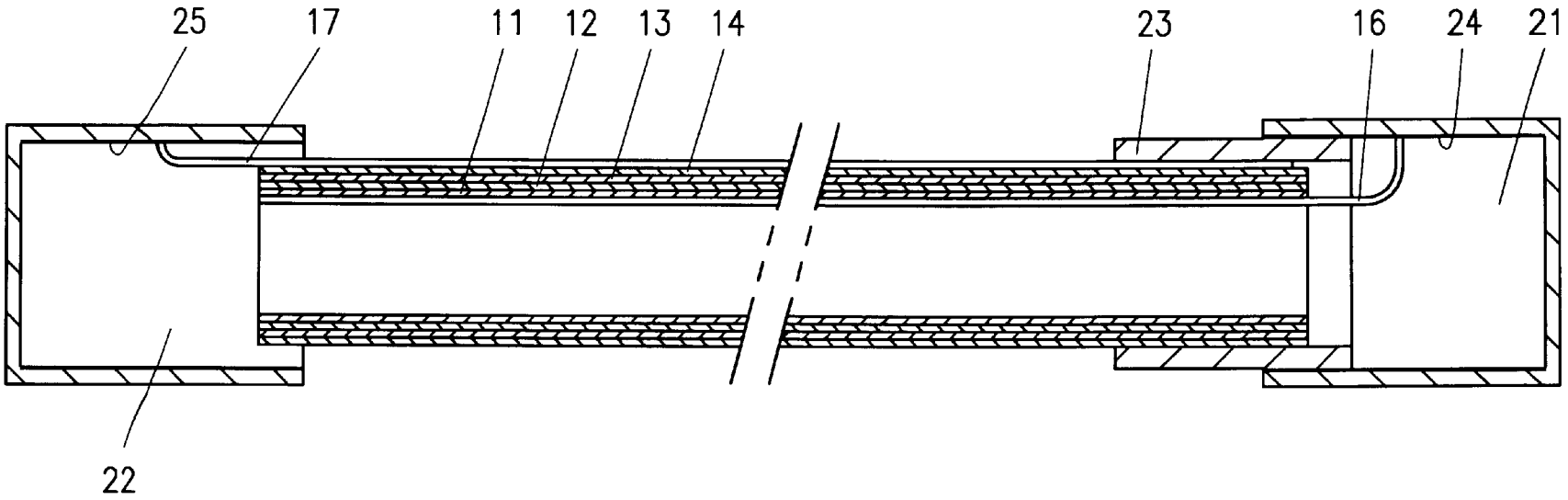
FIG. 3 illustrates schematically a longitudinal section of the cable according to FIG. 2.

According to a preferred embodiment, the first and second extremities of the wires within the cable are connected with first and second shielded connectors 21, 22, for example shielded RJ-45 connectors. As illustrated in FIG. 3, the first foil is connected with a shield 24 of the first connector 21, in particular through the intermediary of the first drain wire 16. Similarly, the second foil is connected with a shield 25 of a second connector 22, in particular through the intermediary of the second drain wire 17. This cable is provided for direct connection with corresponding connectors provided in the devices. The remaining wires of the cable are connected with the shielded connectors 21, 22 in a conventional manner. For the purpose of clarity, these remaining wires are not illustrated in FIG. 3.

Preferably, an insulating element 23 is provided between the first connector 21 and the first extremity of the cable in such a manner that an electrical contact between the second foil and the shield 24 of the first connector 21 is avoided.

For manufacturing the cable according to FIG. 2, the following steps are performed. In a first step, the first 11, 12 is wrapped around over the length of the wires 4 in such a manner that the polyester layer 12 forms the outer layer of the first foil and the aluminium layer 11 the inner layer. In a second step the second foil 13, 14 is wrapped around the first foil in such a manner that the polyester layer 13 forms the inner layer of the second foil and the aluminium layer 14 forms the outer layer of the first form. Upon applying the second foil, care should be taken that overlapping section 20 is not overlapping with overlapping section 19. This enhances the shielding properties of the cable.

Preferably, this second step is preceded by an intermediate step wherein the insulating strip 15 is wrapped around between the first foil and the second foil. Preferably, drain wires 16 and 17 are applied in such a manner that electrical contact is made with respective aluminium layers 11 and 14.

According to an alternative embodiment, manufacturing of a cable according to the invention is performed by applying, in a first step, a first foil of an electrical conductive material, for example aluminium, in a second step an intermediate layer of an insulating material, and in a third step a second foil of an electrical conductive material, for example aluminium, wherein the first and second foils do not comprise a polyester layer or the like.

Figure 4:
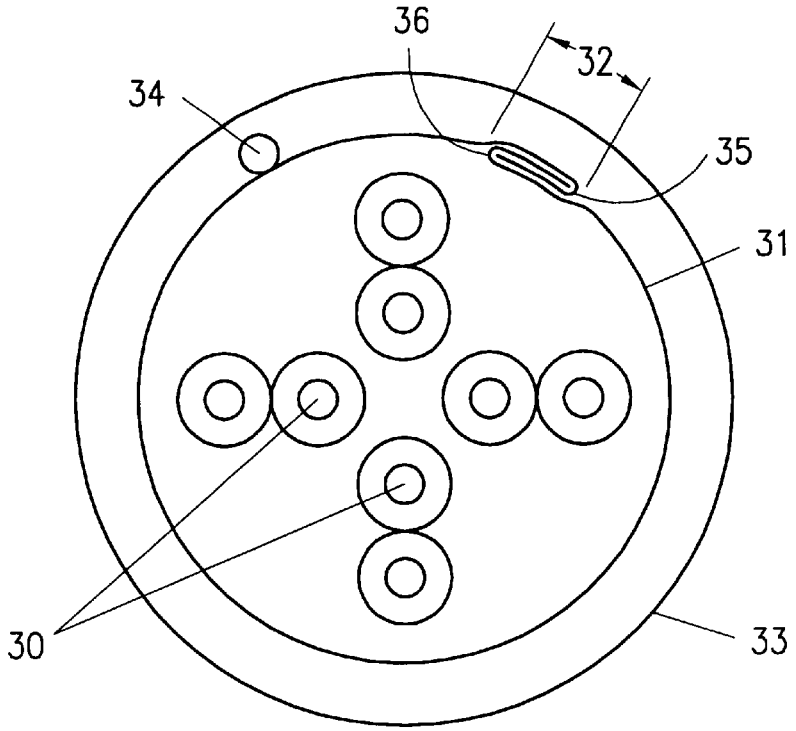
FIG. 4 (PRIOR ART)
FIG. 4 illustrates schematically a cross section of another cable according to the state of the art.

FIG. 4 illustrates another known cable, wherein the wires 30 are surrounded over their length by a first foil 31 of an electrical conductive material, for example aluminium. The first foil forms a first cylinder around the wires and comprises a first overlapping section 32. Optionally, a drain wire 34 is provided at the outer side of the formed cylinder. An outer jacket 33 is further provided around the conductive material. In order to prevent stray currents passing through the first overlapping section 32 and to enhance in this way the shielding properties, first and second extremities 35, 36 each have a C-shape fitting into one another. This particular arrangement renders the manufacturing relatively cumbersome. Moreover, if the cable is provided with a drain wire, care should be taken upon applying the outer jacket that electrical contact between the drain wire 34 and the foil 31 is maintained.

Figure 5:
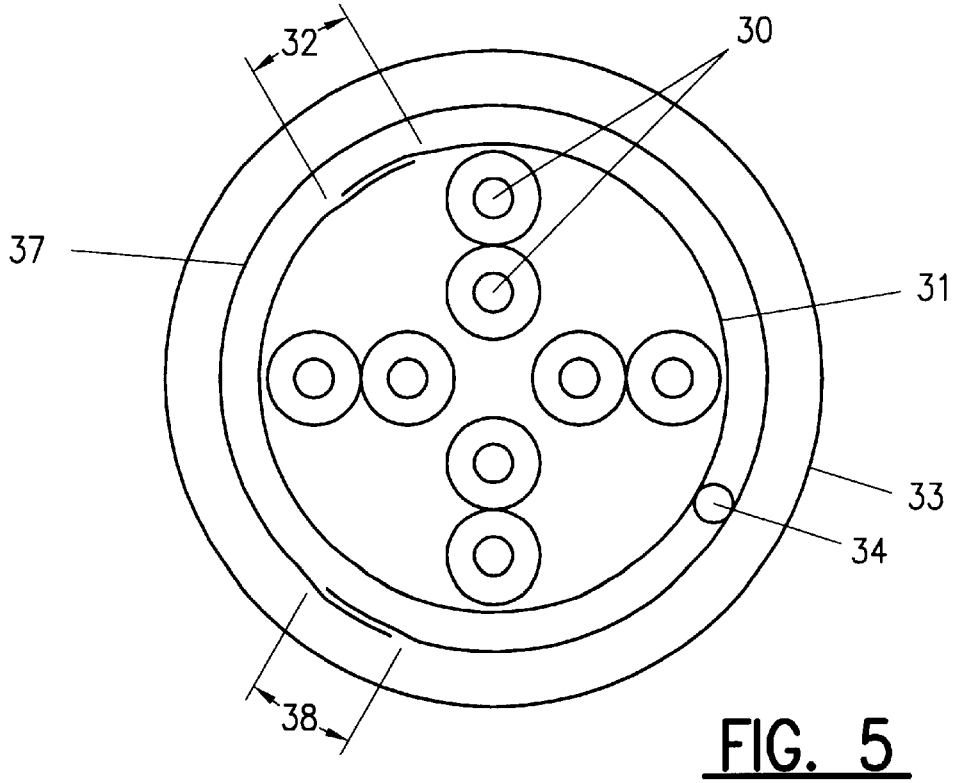
FIG. 5 illustrates schematically a cross section of a further embodiment of a cable according to the invention.

FIG. 5 illustrates a cable according to the invention wherein the first foil 31 is surrounded by a second foil 37 of an electrical conductive material for example aluminium. The second foil forms a second cylinder with a second overlapping section 38. The first and second foils are applied in such a manner that the first and second overlapping sections 32 and 38 are not mutually overlapping. This embodiment wherein two foils are superposed in such a manner that their overlapping sections are not mutually overlapping, is easier to manufacture. It has been found that this embodiment provides essentially the same shielding properties as the embodiment shown in FIG. 4. Moreover, if the cable is provided with a drain wire, electrical contact between the drain wire 34 and the first foil 31 is ensured by enclosing the drain wire between the first and second foils.

I claim:

1. A shielded patch cable comprising a series of wires and a first foil of an electrical conductive material, said first foil surrounding said series of wires over their length, said patch cable further comprising a capacitor for preventing the formation of a grounding loop upon connection of the cable, said capacitor being formed by said first foil surrounded by an intermediate layer of an electrical insulating material, said insulating material is surrounded by a second foil of an electrical conductive material and said patch cable further comprising a first connector mounted on a first extremity of said wires and a second connector mounted on a second extremity of said wires, said first connector comprising a shield of electrical conductive material connected with said first foil, said second connector comprising a shield of electrical conductive material connected with said second foil, and said patch cable further comprising an insulating element mounted between said first extremity of said wires and said first connector, said insulating element being provided for preventing said second foil from electrically contacting said first connector.

2. A shielded patch cable according to claim 1, wherein each of said foils comprises an aluminium layer.

3. A shielded patch cable according to claim 2, wherein said intermediate layer is formed by a polyester layer applied on one side of at least one of said aluminium layers.

4. A shielded patch cable according to claim 3, wherein said intermediate layer is formed by an insulating strip.

5. A shielded patch cable according to claim 4, further comprising a first drain wire electrically contacting said first foil and a second drain wire electrically contacting said second foil.

6. A shielded patch cable according to claim 2, wherein said intermediate layer is formed by an insulating strip.

7. A shielded patch cable according to claim 2, further comprising a first drain wire electrically contacting said first foil and a second drain wire electrically contacting said second foil.

8. A shielded patch cable according to claim 1, further comprising a first drain wire electrically contacting said first foil and a second drain wire electrically contacting said second foil.

9. A method for manufacturing a shielded patch cable comprising a series of wires, a first connector having a shield of electrical conductive material mounted on a first extremity of said wires and a second connector having a shield of electrical conductive material mounted on a second extremity of said wires, said method comprising the steps of:

applying a first foil of an electrically conductive material around said wires;

applying an intermediate layer of an electrically insulating material around said first foil;

applying a second foil of an electrically conductive material around said intermediate layer;

connecting said first foil with the shield of electrical conductive material of said first connector;

connecting said second foil with the shield of electrical conductive material of said second connector;

mounting an insulating element between said first extremity of said wires and said first connector, said insulating element being provided for preventing said second foil from electrically contacting said first connector.

10. A method according to claim 9, wherein said conductive material of said foils include an aluminium layer and wherein at least one of said foils has a polyester layer applied thereto, said foils being applied in such a manner that said polyester layer is located between said aluminium layers.

11. A shielded patch cable comprising a series of wires, a first foil of an electrical conductive material, said first foil surrounding said series of wires over their length and forming a first overlapping section over the length of the cable, said first foil being surrounded by a second foil of an electrical conductive material, said second foil forming a second overlapping section over the length of the cable, said first and second foils being located in such a manner that said overlapping sections are not mutually overlapping said patch cable further comprising a first connector mounted on a first extremity of said wires and a second connector mounted on a second extremity of said wires, said first connector comprising a shield of electrical conductive material connected with said first foil, said second connector comprising a shield of electrical conductive material connected with said second foil, and said patch cable further comprising an insulating element mounted between said first extremity of said wires and said first connector, said insulating element being provided for preventing said second foil from electrically contacting said first connector.

* * * * *